US005137172A

United States Patent [19]

Wagner et al.

[11] Patent Number: 5,137,172

[45] Date of Patent: Aug. 11, 1992

[54] PAPER FEED SYSTEM

[75] Inventors: Richard C. Wagner, Frankfort, Ill.; James D. Azzar, c/o Hollymatic Corporation, 600 E. Plainfield Rd., Countryside, Ill. 60525

[73] Assignees: Hollymatic Corporation, Countryside, Ill.; James D. Azzar, Grand Rapids, Mich.

[21] Appl. No.: 632,756

[22] Filed: Dec. 24, 1990

[51] Int. Cl.[5] ..... B65H 3/58

[52] U.S. Cl. ..... 221/26; 221/36; 221/312 R; 271/131; 271/165

[58] Field of Search ..... 221/26, 33, 36, 312 R; 312/50, 60; 211/50; 271/131, 137, 165, 166, 169, 133, 135

[56] References Cited

U.S. PATENT DOCUMENTS

| | | | |
|---|---|---|---|
| 691,294 | 1/1902 | Schilz . | |
| 1,366,275 | 1/1921 | Payzant | 312/60 |
| 2,198,176 | 4/1940 | Perrin | 221/36 |
| 2,554,821 | 5/1951 | Garfunkel . | |
| 3,232,478 | 2/1966 | Thomasma et al. . | |
| 3,461,483 | 8/1969 | Felstehausen . | |
| 3,589,711 | 6/1971 | Holly . | |
| 4,283,812 | 8/1981 | Corominas . | |
| 4,346,817 | 8/1982 | Karcher | 221/312 R |
| 4,530,132 | 7/1985 | Wagner . | |
| 4,537,307 | 8/1985 | Tamura . | |
| 4,597,134 | 7/1986 | Wagner . | |

*Primary Examiner*—H. Grant Skaggs

*Attorney, Agent, or Firm*—Wood, Phillips, Van Santen, Hoffman & Ertel

[57] ABSTRACT

A paper feed system suitable for use with a patty making machine to provide paper for separating patties, including a stack of sheet-form paper having a deformable element on the side edge thereof, a paper hopper, and a guide on the inside surface of a sidewall of the paper hopper for engaging the deformable element. Two guides are provided, each on opposite sidewalls of the hopper, engaging deformable elements on opposite sides of the paper stack. Preferably, the guides are male guides extending from the sidewalls with the end adjacent to where the paper is dispensed thicker than the remainder of the guide to support the paper. The deformable elements cooperate with the guides so that the paper is deformed by an extreme bend, but not torn, when each sheet is dispensed from the hopper. A stack of individual sheets of paper usable with this system includes recesses on opposite sides of each sheet of paper, where the recesses receive the guides when stacked in the hopper. The paper is bent at an extreme angle when pulled free of the guides without tearing when the bottom-most individual sheet is dispensed from the hopper.

6 Claims, 4 Drawing Sheets

PAPER FEED SYSTEM

FIELD OF THE INVENTION

The present invention is directed to a system for feeding sheet-form paper having a deformable element to a patty making machine and, more particularly, to a paper feed system having a paper hopper adapted to receive and dispense the paper and having a guide associated with the inside surface of a sidewall of the hopper for engaging the deformable element.

BACKGROUND OF THE INVENTION

Before automation, it was common to form patties of materials, such as ground meat, by hand. However, this technique has numerous drawbacks including the unsanitary conditions resulting from human contact with the material, the lack of uniformity in the weight, size, and shape of the patties and the limitations of per worker output inherent in labor intensive processes.

Apparatus for forming patties overcome many of the shortcomings of hand-forming patties. These apparatus can produce patties in a sanitary manner that are substantially uniform in size, shape, and weight and result in significant increase in per worker output. Representative of these apparatus are U.S. Pat. No. 4,283,812 to Corominas, U.S. Pat. No. 4,302,868 to Wagner (the '868 Patent to Wagner), and U.S. Pat. No. 4,597,134 to Wagner.

Typically, the patty making apparatus has a mechanism that dispenses paper to be contacted with the patty to insure the separation of the patty from other patties and surfaces. Representative paper dispensing mechanisms are disclosed in the aforementioned patents and in U.S. Pat. Nos. 2,554,821 to Garfunkel and 3,461,483 to Felstehausen.

Unfortunately, the paper dispensing mechanism often requires rolls of paper that are cut or torn to the desired length. These rolls must be replaced which can result in the patty making apparatus being shut down thereby interrupting the patty making process.

Other paper dispensing mechanisms utilize precut sheets of paper that have a hole in the back of the paper. Sheets of paper are arranged in a stack with the aligned holes fitted over a rod or pin from which the paper is torn during dispensing. Unfortunately, requiring a rod be threaded through the hole increases the difficulty in loading the paper.

Further, patties are sometimes formed longer front-to-back than side-to-side to account for shrinkage that occurs during cooking. Having a hole in the back of the paper results in a gap in the paper that usually is expanded when the paper is torn from the rod. The gap can result in an exposed surface of the patty undesirably adhering to, or being contaminated by, other surfaces. The length of the paper can be increased to compensate for this gap. However, lengthening is undesirable because of the increased expense associated with increased paper consumption.

Also, cutting or tearing of the paper by the paper dispensing mechanism can undesirably result in small fragments of paper being deposited upon the patty.

It is desired to provide a paper feed system suitable for use with a patty making machine that overcomes the aforementioned shortcomings.

SUMMARY OF THE INVENTION

In one aspect of the present invention, a paper feed system suitable for use with a patty making machine to provide paper for separating patties is provided, including a stack of sheet-form paper having a deformable element on the side edge thereof, a paper hopper, and a guide on the inside surface of a sidewall of the paper hopper for engaging the deformable element.

In a preferred aspect of the present invention, two guides are provided, each on opposite sidewalls of the hopper, engaging deformable elements on opposite sides of the paper stack. Further, the guides are male guides extending from the sidewalls with the end adjacent to where the paper is dispensed thicker than the remainder of the guide to ensure that the paper is properly supported with its deformable elements in engagement with the guides. In either case, the deformable elements cooperate with the guides so that the paper is deformed by an extreme bend, but not torn, when each sheet is dispensed from the hopper.

In another aspect of the present invention, sheet-form paper for use with the above described system is provided, where the paper is a stack of individual sheets of paper having recesses on opposite sides of each sheet of paper, said recesses receiving the guides when stacked in the hopper. The paper is bent at an extreme angle when pulled free of the guides without tearing when the bottom-most individual sheet is dispensed from the hopper.

It is an object of the present invention to provide a paper feed system for a patty making machine in which single sheets of paper may be reliably fed between formed meat patties.

It is another object of the present invention to provide a paper feed system which does not introduce any loose shreds of paper into the patty environment (which shreds could undesirably get mixed with the meat).

Still another object of the present invention is to provide a paper feed system which will operate reliably with low amounts of paper in the system.

Numerous other advantages and features of the present invention will become readily apparent from the following detailed description of the invention, the accompanying Figures and the appended claims.

DETAILED DESCRIPTION OF THE PREFERRED EMBODIMENTS

Although this invention is susceptible to embodiment in many different forms, preferred embodiments of the invention are shown. It should be understood, however, that the present disclosure is to be considered as an exemplification of the principles of this invention and is not intended to limit the invention to the embodiments illustrated.

Figure 1:
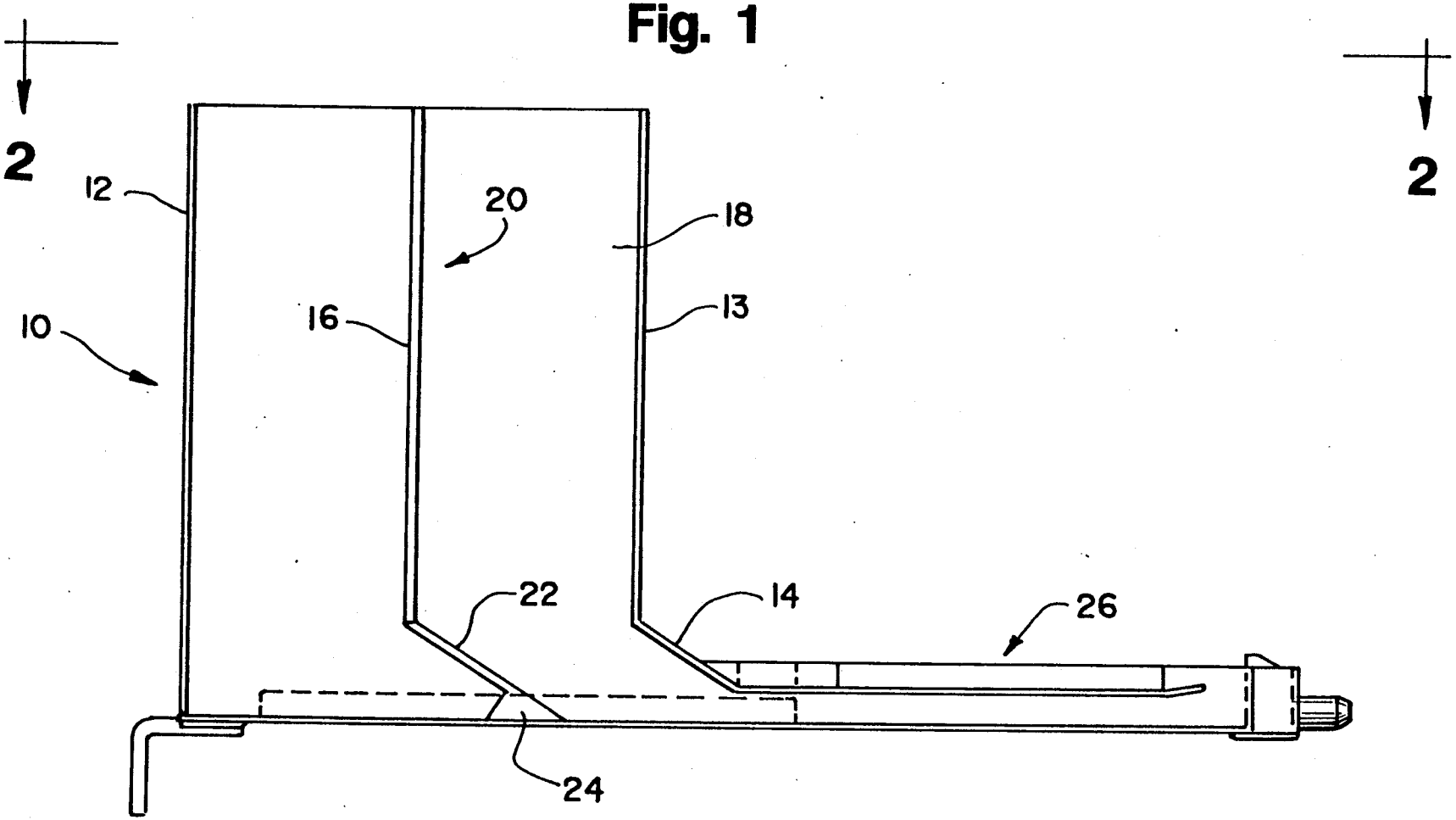
FIG. 1 is a side sectional view of the paper feed system 10.
Figure 2:
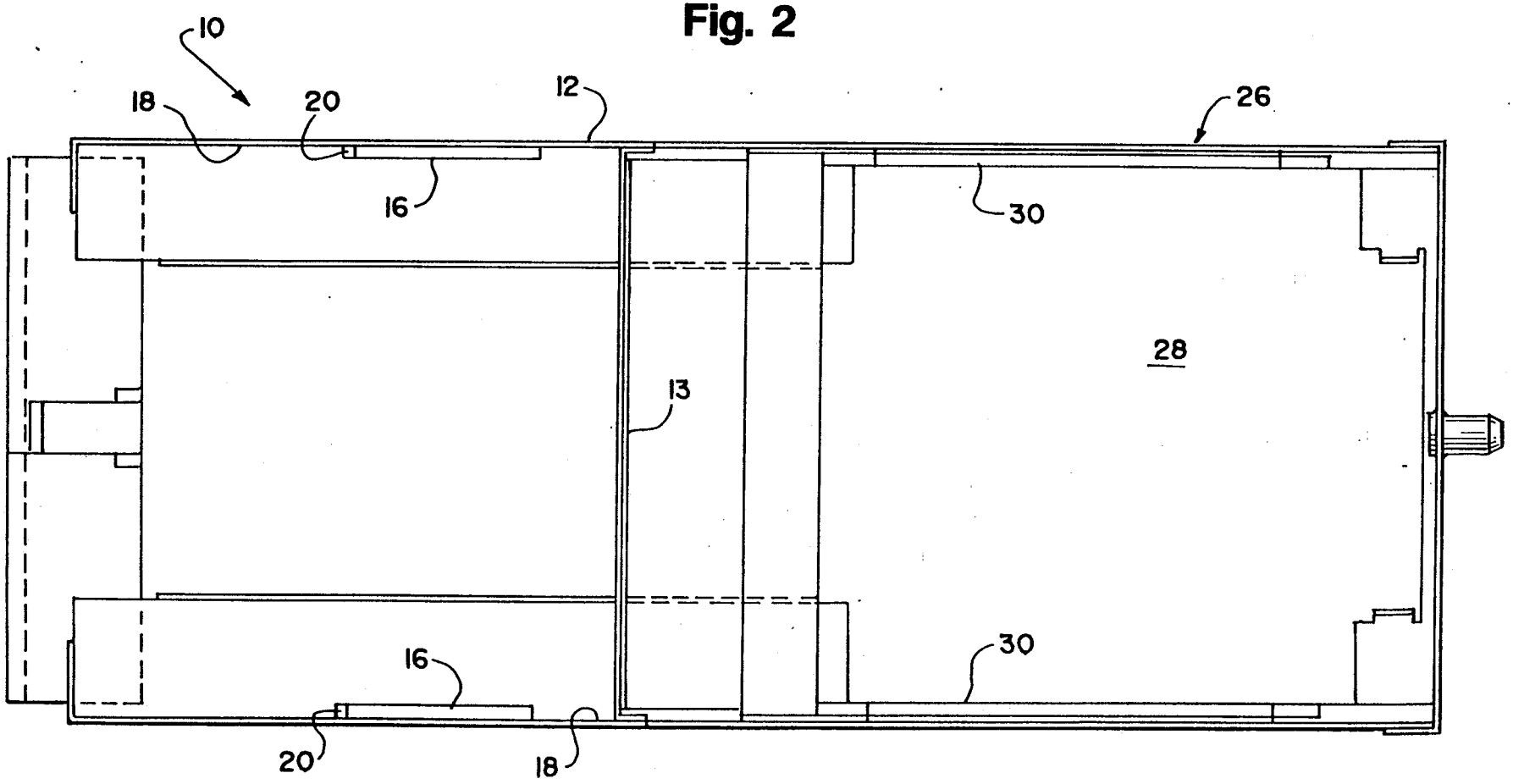
FIG. 2 is a top elevational view of the paper feed system 10 taken along line 2—2 of FIG. 1.

FIGS. 1 and 2 illustrate a preferred embodiment of the present paper feed system 10 having a paper hopper 12 that is adapted to receive and temporarily retain sheetform paper and to dispense the paper. This paper feed system can be utilized with many conventional patty making machines.

The hopper 12 can be constructed so as to be adjustable to receive different sizes of paper, although it has been found that different size interchangeable hoppers can be inexpensively provided and easily changed on the system 10 to adjust for different patty and/or paper sizes.

A guide 16 is associated with the interior surface of each of the sidewalls 18 of the hopper 12. In the preferred embodiment, the guides 16 are male elements extending from the surfaces as illustrated. Alternatively, however, one or both of the guides can be a female element extending into the sidewall. Further, it should be understood that the present invention may have a guide associated with only one sidewall, or could have more than one guide can be associated with a sidewall.

The hopper 12 has a front 13 from which the paper is dispensed. The front 13 can be a wall or can be defined by the front edge of the paper.

FIG. 1 illustrates the guide 16 having a proximal end 24 that is adjacent to where the paper is dispensed and that has a different thickness than (i.e., is tapered wider than) another section 20 of the guide 16. The thickness of the other guide section 20 allows the deformable element to slide over the male guide (or in the female guide) quickly and easily with a minimum of frictional force therebetween until the paper is adjacent to the location where the paper is dispensed. By beginning the taper of the proximal end 24 at substantially the level at which the paper is intended to be supported, the proximal end 24 itself serves to ensure that the paper remains in engagement with the guide 16. That is, taper of the proximal end 24 prevents the sides of the paper from sagging (i.e., curling in) clear of the guides 16, and thereby ensures that a reliable hold back force is provided on all sheets so as to prevent double sheet pulls (i.e., pulling more than the bottom sheet).

As shown in FIG. 1, the proximal end 24 of the male guide 16 is thicker than the other section 20. The guide 16 also preferably has a segment 22 near where the paper is dispensed that is sloped towards the front 13 to feather the paper. (The term "feather", as used in its various grammatical forms to define the relationship between successive sheets of paper being acted upon by the sloped segment, indicates that the leading, or front, edge of the sheet of paper to be immediately dispensed is slightly forward of the leading edge of the next sheet of paper to be dispensed which is slightly forward of the leading edge of the next paper to be dispensed.) The hopper 12 also has a sloped front segment 14 which works with the sloped segment 22 to feather the paper.

The hopper 12 can be attached to a frame 26 that defines an opening 28, and includes ledges 30 extending into the opening 28 substantially along the length of the frame 26 which support paper within the opening 28. The '868 Patent to Wagner discloses a molding apparatus wherein a formed patty is dropped through such a frame having a sheet of paper supported across the opening to apply a sheet of paper to the patty.

Figure 3B:
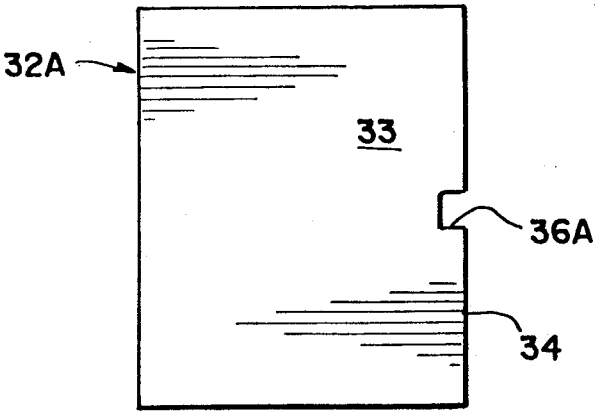
FIG. 3A, B and C are top elevational views of different embodiments of the sheet-form paper.
Figure 3C:
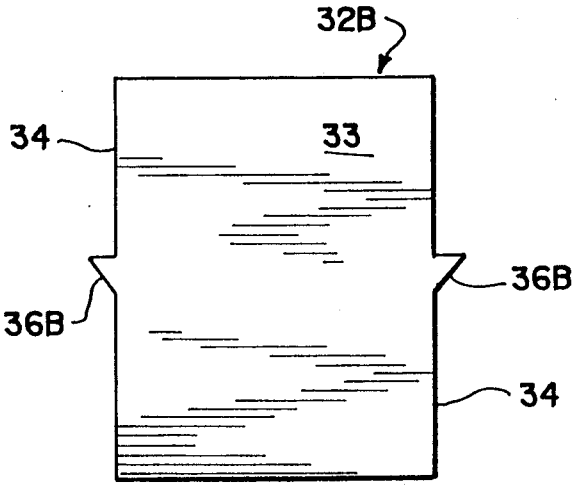
Figure 3A:
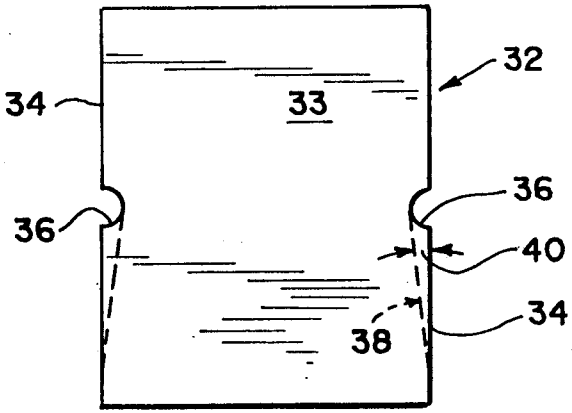

FIGS. 3A, B and C illustrate the sheet-form paper 32 of the present invention.

As shown in FIG. 3A, the preferred embodiment of the paper 32 has a body 33 and notch-like deformable elements 36 extending into, and defined by, the body 33 from both opposed side edges 34. This embodiment works with a hopper 12 having male guides 16 such as previously disclosed. As previously discussed, the elements 36 cooperate with the guide proximal end 24 so that the bend 38 (shown in dashed lines) is relatively long and thus the "hold back" force is sufficiently great to prevent double sheet pulls. (It has been found that 5.5" square paper such as is typically used with patty making machines will work properly with semicircular notches having a radius of approximately 0.1".)

FIG. 3B illustrates an alternative embodiment wherein the paper 32A has a notch-like deformable element 36A extending into the body 33 from only one side edge 34.

FIG. 3C illustrates another alternative embodiment wherein the paper 32B has tab-like deformable elements 36B extending out from the opposed side edges 34 in the same plane as the body 33. (Alternatively, a deformable element can extend from the side edge and form an obtuse angle with the body of the paper.) This embodiment works with a hopper 12 having female guides.

The sheet-form paper can be composed of any material such as wood, plastic, and the like and is preferably a paper that inhibits moisture transport therethrough.

The paper deformable element is selected to be engaged by, and cooperate with, the guide. The retaining force can be adjust by changing the relative dimensions and/or shapes of the guide and deformable element.

When a dispensing force is exerted on the paper (as is commonly provided, for example, by a reciprocating member frictionally engaging the surface of the paper), the deformable element of the first sheet of paper to be immediately dispensed is temporarily or permanently deformed to free it from its associated guide and thus permit the first sheet to be supplied to the patty making machine. Since the reciprocating member contacts only the dispensed sheet, the dispensing force is not applied to the next sheet of paper. Further, the friction force between the bottom sheet being dispensed and the next sheet is insufficient to pull the next sheet free of the guide, as it is not sufficient to overcome the "hold back" force resulting from the extreme bend required to free the paper from the guides 16. Accordingly, the next sheet is maintained within the hopper 12 by its deformable element, and thus paper is reliably dispensed only a single sheet at a time.

Further, as best shown in FIG. 1, the increased thickness (i.e., width) of the guide 16 at its proximal end 24 has been found to force the paper (see particularly the paper 32 shown in FIG. 3A) to fold into an extreme bend (by "extreme bend", it is meant that the angle 40 [see FIG. 3A] is less than 60°, and preferably less than 30°, so that the bend is relatively long). This causes a sufficiently great "hold back" force to be present so that only the bottom-most sheet of paper (which is the only sheet having force directly applied to it) encounters a force sufficiently great to pull it free from the stack, and thus double sheet pulls (i.e., feeding of more than one sheet at a time) are prevented.

Still further, it has been found that notched paper and guides such as described above result in the paper being quickly and easily shifted laterally in the hopper 12, particularly as compared with the operation of prior art feeders utilizing a pin received in a hole in the paper. Thus, the height of the "lock area" is minimized (the "lock area" is the angled area where the paper is feathered) by allowing a steeper angle of the sloped segment 22 to be utilized (as illustrated, the present invention may utilize a slope of merely 30° from horizontal). As a result, the system 10 allows the hopper 12 to be run with a smaller stack of paper without missing paper during operation (missed paper on some strokes occurs when the paper does not fill the "lock area").

Figure 4:
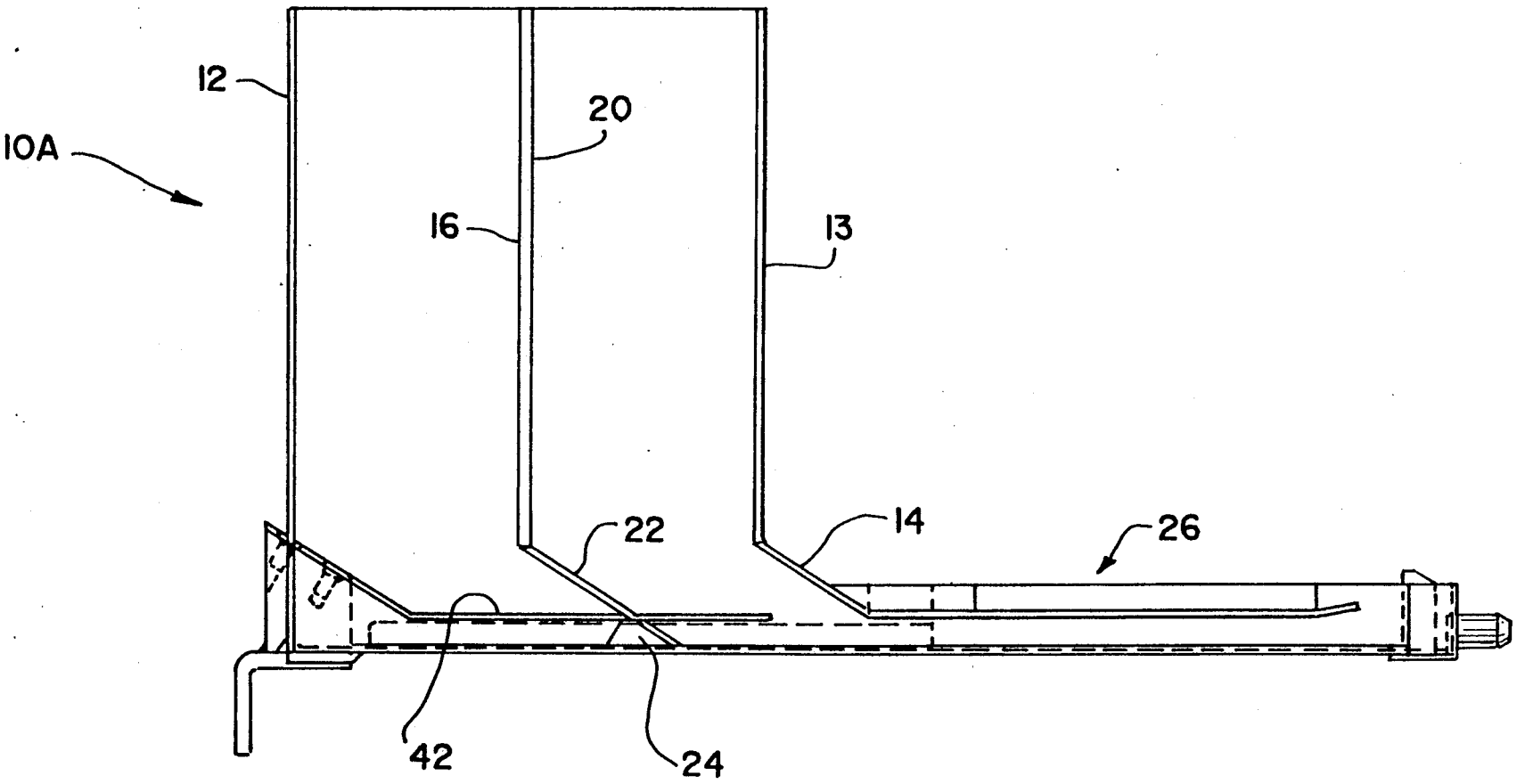
FIG. 4 is a side sectional view of an alternative embodiment of the paper feed system 10A.

FIG. 4 illustrates a preferred embodiment of the paper feed system 10A including a support 42 to inhibit the middle of the paper from sagging when the patty making machine (not shown) does not prevent sagging. (As previously discussed, the support 42 is preferably at the same height as the top portion of the guide proximal end 24, to ensure that the paper remains flat and thus does not curl along the edges away from the guides.) The paper feed system including support would preferably be utilized with an apparatus such as that disclosed in the '868 Patent to Wagner which moves a sheet of paper into the frame utilizing a moveable carrier having spaced sheet engaging means that comprise friction straps. The support can be positioned between the friction straps or on either side of the carrier.

When the patty making machine includes a device which inhibits sagging of the paper, the support is preferably not present. Such a device can also provide the dispensing force.

It will thus be understood by those who have obtained knowledge of the present invention that individual sheets of paper can be readily utilized to separate individual formed patties of meat, and this can be accomplished without any undesirable shreds of paper getting attached to the patties.

Still further, such individuals will understand the above described paper feed system will reliably feed single sheets of paper between formed meat patties, and such system can be operated reliably even when relatively low amounts of paper remain in the system (thereby allowing the operator to spend his time more productively without being required to constantly monitor the paper levels and continually add paper).

This invention has been described in terms of specific embodiments set forth in detail, but it should be understood that these are by way of illustration only and that the invention is not necessarily limited thereto. Modifications and variations will be apparent from this disclosure and may be resorted to without departing from the spirit of this invention, as those skilled in the art will readily understand. Accordingly, such variations and modifications of the disclosed products are considered to be within the purview and scope of this invention and the following claims.

We claim:

1. A paper feed system suitable for use with a patty making machine to provide paper for separating patties, said patty making machine including means for selectively feeding sheet-form paper from said paper feed system to patties made by said machine, comprising:

a stack of sheet-form paper having deformable arcuate notches in opposite side edges thereof;

a paper hopper having a front, a first sidewall, and an opposed second sidewall, the paper hopper being adapted to receive and temporarily retain the paper and adapted to dispense the paper from the front; and means for engaging the arcuate side notches, the engaging means being male guides extending from the inside surface of the first and second sidewalls of the paper hopper and engaging said notches to maintain alignment of the stack of paper in the hopper and to force said paper to fold over at an extreme bend during dispensing of the paper.

2. A paper feed system suitable for use with a patty making machine to provide paper for separating patties, said patty making machine including means for selectively feeding sheet-form paper from said paper feed system to patties made by said machine, comprising:

a stack of sheet-form paper having deformable arcuate notches in opposite side edges thereof;

a paper hopper having a front, a first sidewall, and an opposed second sidewall, the paper hopper being adapted to receive and temporarily retain the paper and adapted to dispense the paper from the front; and means for engaging the arcuate side notches, the engaging means being male guides extending from the inside surface of the first and second sidewalls of the paper hopper and engaging said notches to maintain alignment of the stack of paper in the hopper, each of said male guides further having a proximal end adjacent to where the paper is dispensed tapered outwardly to support the paper thereon.

3. The paper feed system as defined in claim 2 further comprising means at the bottom of the paper hopper for supporting the paper at substantially the level of the proximal end of the guides to inhibit sagging of the paper therein.

4. A paper feed system suitable for use with a patty making machine to provide paper for separating patties, said patty making machine including means for selectively feeding sheet-form paper from said paper feed system to patties made by said machine, comprising:

a stack of sheet-form paper having deformable arcuate notches in opposite side edges thereof;

a paper hopper having a front, a first sidewall, and an opposed second sidewall, the paper hopper being adapted to receive and temporarily retain the paper and adapted to dispense the paper from the front; and means for engaging the arcuate side notches, the engaging means being associated with the inside surface of the first and second sidewalls of the paper hopper and having a segment adjacent to where the paper is dispensed that slopes toward the front of the hopper.

5. A paper feed system suitable for use with a patty making machine to provide paper for separating patties, said patty making machine including means for selectively feeding sheet-form paper from said paper feed system to patties made by said machine, comprising:

a stack of sheet-form paper having a semicircular notch in each of the opposed side edges thereof;

a paper hopper having a front, a first sidewall and an opposed second sidewall, the paper hopper being adapted to receive and temporarily retain the paper and adapted to dispense the paper from the front; and a guide projecting inwardly from the inside surface of each of the sidewalls, each guide being longitudinally disposed and semicircular in cross-section, said guides being received in the notches on the associated sides of the paper stacked in said hopper whereby said paper is deformed but not torn when each sheet is dispensed from the hopper, said guides further having proximal ends adjacent to where the paper is dispensed, said proximal ends being tapered to a greater front to back width than the remainder of said guides to support the paper thereon.

6. A paper feed system suitable for use with a patty making machine to provide paper for separating patties, said patty making machine including means for selectively feeding sheet-form paper from said paper feed system to patties made by said machine, comprising:

a stack of sheet-form paper having a deformable element on the side edge thereof;

a paper hopper having a front, a first sidewall, and an opposed second sidewall, the paper hopper being adapted to receive and temporarily retain the paper and adapted to dispense the paper from the front;

a male guide for engaging the deformable element, said guide being associated with the inside surface of the first sidewall of the paper hopper and having a proximal end adjacent to where the paper is dispensed tapered outwardly to support the paper thereon; and means at the bottom of the paper hopper for supporting the paper at substantially the level of the guide proximal end to inhibit sagging of the paper therein.

* * * * *